US008603717B2

(12) United States Patent
Park et al.

(10) Patent No.: US 8,603,717 B2
(45) Date of Patent: Dec. 10, 2013

(54) TONER HAVING MULTIPLE INFLECTION POINTS ON STORAGE MODULUS CURVE WITH RESPECT TO TEMPERATURE AND METHOD OF PREPARING THE SAME

(75) Inventors: Jae Bum Park, Daejeon (KR); Woo Young Yang, Daejeon (KR); Keon Il Kim, Daejeon (KR); Dae Il Hwang, Daejeon (KR); Il Hyuk Kim, Daejeon (KR); Il Sun Hwang, Daejeon (KR); Jae Kwang Hwang, Daejeon (KR); Dae Woong Choi, Daejeon (KR); Dong Won Kim, Daejeon (KR); Duck Kyun Ahn, Daejeon (KR)

(73) Assignee: Samsung Fine Chemicals Co., Ltd., Ulsan (KR)

( * ) Notice: Subject to any disclaimer, the term of this patent is extended or adjusted under 35 U.S.C. 154(b) by 156 days.

(21) Appl. No.: 13/003,762

(22) PCT Filed: Jul. 22, 2009

(86) PCT No.: PCT/KR2009/004054
§ 371 (c)(1),
(2), (4) Date: Jan. 11, 2011

(87) PCT Pub. No.: WO2010/011079
PCT Pub. Date: Jan. 28, 2010

(65) Prior Publication Data

US 2011/0116841 A1 May 19, 2011

(30) Foreign Application Priority Data

Jul. 23, 2008 (KR) ..... 10-2008-0071905

(51) Int. Cl.
*G03G 9/08* (2006.01)

(52) U.S. Cl.
USPC ..... 430/111.4; 399/252

(58) Field of Classification Search
USPC ..... 430/111.4; 399/252
See application file for complete search history.

(56) References Cited

U.S. PATENT DOCUMENTS

| | | | | |
|---|---|---|---|---|
| 5,753,399 | A * | 5/1998 | Hayase et al. | 430/109.3 |
| 6,002,903 | A | 12/1999 | Hayase et al. | |
| 6,040,104 | A | 3/2000 | Nakamura et al. | |
| 2004/0229148 | A1 | 11/2004 | Kadota et al. | |
| 2006/0040197 | A1 | 2/2006 | Kabai | |
| 2008/0090162 | A1 * | 4/2008 | Tsunemi | 430/96 |

FOREIGN PATENT DOCUMENTS

| | | |
|---|---|---|
| EP | 2249208 A1 | 11/2010 |
| EP | 2296044 A1 | 3/2011 |
| JP | 5-249735 | 9/1993 |
| JP | 6-059504 | 3/1994 |

(Continued)

OTHER PUBLICATIONS

Extended European Search Report and Opinion in Patent Application No. 09800560.6, dated Jun. 4, 2012.

(Continued)

*Primary Examiner* — Mark A Chapman
(74) *Attorney, Agent, or Firm* — Nixon Peabody LLP

(57) ABSTRACT

Provided are a toner and a method of preparing the same. The toner includes a binder resin, a coloring agent, and at least one additive, and a storage modulus curve of the toner with respect to temperature has multiple inflection points. The toner may be used in an electrophotographic image forming apparatus.

6 Claims, 2 Drawing Sheets

(56) References Cited

FOREIGN PATENT DOCUMENTS

| | | | |
|---|---|---|---|
| JP | 7-234542 | | 9/1995 |
| JP | 7-295298 | | 11/1995 |
| JP | 8-054750 | | 2/1996 |
| JP | 8-278662 | | 10/1996 |
| JP | 10-171156 | | 6/1998 |
| JP | 11-007151 | | 1/1999 |
| JP | 11-084716 | | 3/1999 |
| JP | 1999-194542 | A | 7/1999 |
| JP | 2001-154398 | | 6/2001 |
| JP | 2004-198692 | | 7/2004 |
| JP | 2005-049484 | A | 2/2005 |
| JP | 2008-129308 | A | 6/2008 |
| JP | 2008-165017 | A | 7/2008 |

OTHER PUBLICATIONS

International Search Report, PCT/KR2009/004054, dated Feb. 17, 2010.

Japanese Office Action in Japanese Application No. 2011-519988, mailed on Jul. 4, 2013.

* cited by examiner

TONER HAVING MULTIPLE INFLECTION POINTS ON STORAGE MODULUS CURVE WITH RESPECT TO TEMPERATURE AND METHOD OF PREPARING THE SAME

CROSS-REFERENCE TO RELATED PATENT APPLICATION

This application is a national phase of International Application No. PCT/KR2009/004054, entitled, "Toner Having Multiple Inflection Points On Storage Modulus Curve With Respect To Temperature And Method Of Preparing The Same", which was filed on Jul. 22, 2009, and which claims priority of Korean Patent Application No. 10-2008-0071905, filed Jul. 23, 2008.

TECHNICAL FIELD

The present invention relates to a toner and a method of preparing the same, and more particularly, to a toner having excellent fixing properties at low temperature, resistance to hot offset, and heat-resistant storage properties obtained by having multiple inflection points on a storage modulus curve with respect to temperature and a method of preparing the same.

BACKGROUND ART

The need for a toner suitable for high-speed printing, particularly toner capable of improving image quality and preventing hot offset is increasing in the printing industry. "Hot offset" is a phenomenon whereby melted toner on a printing paper adheres to a fixing device after passing through the fixing device when an amount of toner exceeding the amount required to be fixed on the printing paper is excessively melted when the toner is heated while passing through the fixing device.

Thus, toner requires resistance to hot offset.

In particular, toner used for full color printing needs to sufficiently realize and reproduce a desired color by a fixing process using heating and pressurizing without reducing clearness of images. Thus, the toner used for full color printing is required to include a low molecular weight binder resin that melts instantly. However, since the aggregating ability of the instantly melting low molecular weight binder resin decreases during the fixing process using heating and pressurizing, hot offset may easily occur.

In this regard, toner having a predetermined storage modulus and loss modulus at a specific temperature range has been reported.

Japanese Patent Publication No. 1996-054750 discloses a toner having a predetermined storage modulus at 170° C., and Japanese Patent Publication No. 1999-084716 discloses a toner having a predetermined loss modulus at 180° C. However, these toners have the confrontation of fixing properties at low temperature and hot offset properties, and poor heat-resistant storage properties due to low viscosity.

Japanese Patent Publication No. 1994-059504 discloses a toner having a predetermined storage modulus at a temperature ranging from 70 to 120° C., and Japanese Patent Publication No. 1999-007151 discloses a predetermined loss modulus at a temperature ranging from 130 to 180° C. However, these toners have poor heat-resistant storage properties, resolution, charging properties, and developing properties.

Japanese Patent Nos. 1993-249735, 1995-234542, 1995-295298, 1996-278662, and 1998-171156 disclose toners having a desired storage modulus, loss modulus, or loss tangent that is a ratio of a loss modulus to a storage modulus in a predetermined temperature range. However, storage properties, preservation properties, glossiness of those toners are not sufficient for a color toner.

Thus, there is still a need to develop a toner having excellent charging properties, developing properties, glossiness, fixing properties, and resistance to hot offset.

DETAILED DESCRIPTION OF THE INVENTION

Technical Problem

The present invention provides a toner having excellent fixing properties at low temperature, resistance to hot offset, and heat-resistant storage properties obtained by having multiple inflection points on a storage modulus curve with respect to temperature and a method of preparing the same.

The present invention also provides an electrophotographic image forming apparatus employing the toner.

Technical Solution

According to an aspect of the present invention, there is provided a toner including a binder resin, a coloring agent, and at least one additive, wherein a storage modulus (G') curve of the toner with respect to temperature (T) has multiple inflection points.

All the multiple inflection points may exist at a temperature ranging from 100 to 200° C.

The binder resin may include multiple types of binder resins having different number average molecular weights and glass transition temperatures (Tg).

The binder resin may include a binder resin A having a number average molecular weight ranging from 5,000 to 30,000 and a glass transition temperature (Tg) ranging from 55 to 60° C. and a binder resin B having a number average molecular weight ranging from 5,000 to 30,000 and a glass transition temperature (Tg) ranging from 62 to 67° C.

The weight ratio of the binder resin A:the binder resin B may be in the range of 10:90 to 90:10.

The toner may further include a cross-linked resin.

According to another aspect of the present invention, there is provided a method of preparing a toner having multiple inflection points on a storage modulus (G') curve with respect to temperature (T) using a plurality of binder resins, wherein the number average molecular weight and the glass transition temperature (Tg) of each of the plurality of binder resins are controlled using at least one of the group consisting of regulating a composition ratio of monomers, adding a macromonomer, and adding a chain transfer agent.

According to another aspect of the present invention, there is provided an electrophotographic image forming apparatus employing the toner.

BRIEF DESCRIPTION OF THE DRAWINGS

The above and other features and advantages of the present invention will become more apparent by describing in detail exemplary embodiments thereof with reference to the attached drawings in which.

BEST MODE FOR CARRYING OUT THE INVENTION

Figure 1:
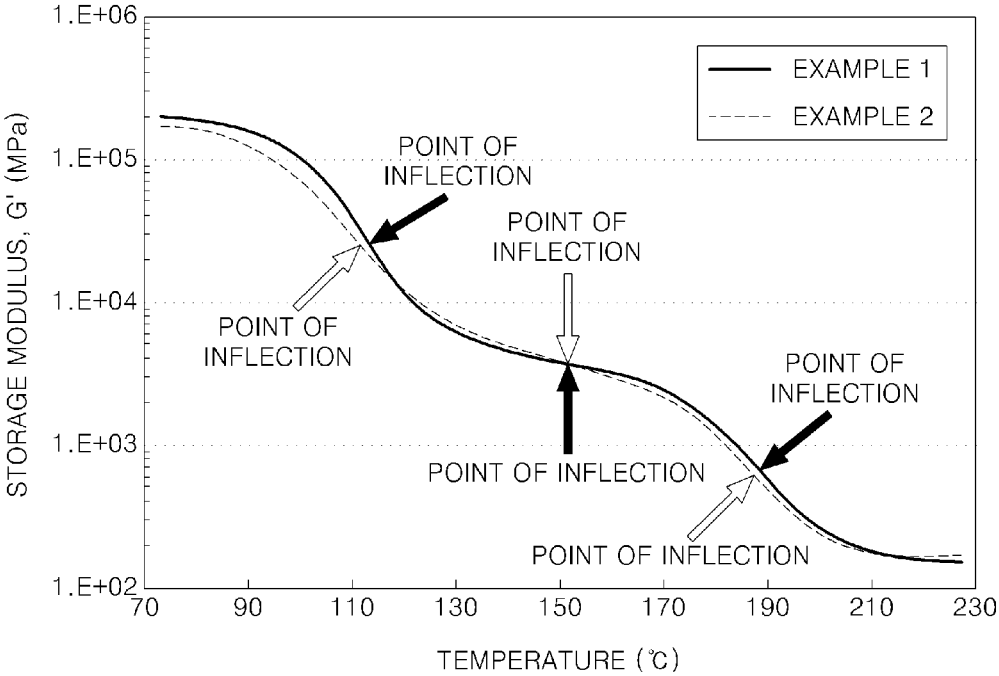
FIG. 1 is a graph illustrating storage moduli, with respect to temperature, of toners prepared according to Examples 1 and 2.

Hereinafter, the present invention will be now be described more fully with reference to the accompanying drawings, in which exemplary embodiments of the invention are shown.

A toner according to an embodiment of the present invention includes a binder resin, a coloring agent, and at least one additive. A storage modulus curve of the toner with respect to temperature has multiple inflection points. In this regard, an inflection point of the storage modulus refers to a point where a second derivative of the storage modulus G' is zero in the storage modulus G' curve with respect to temperature T (i.e., $d^2G'/dT^2=0$). All the multiple inflection points may exist at a temperature ranging from 100 to 200° C., but the temperature range is not limited thereto. Accordingly, due to multiple inflection points, fixing properties at low temperature, resistance to hot offset, and heat-resistant storage properties of toner may be improved, which will be described later.

The toner according to the present embodiment may include multiple types of binder resins having different number average molecular weights and glass transition temperatures such that the storage modulus curve of the toner with respect to temperature has multiple inflection points. However, the present invention is not limited thereto. The same effect may be obtained by preparing at least two toners having different fixing temperature ranges and mixing the two toners. According to the present embodiment, the binder resin may be prepared by mixing two types of binding resins: a binder rein A having a number average molecular weight ranging from 5,000 to 30,000 and a glass transition temperature Tg ranging from 55 to 60° C. and a binder resin B having a number average molecular weight ranging from 5,000 to 30,000 and a Tg ranging from 62 to 67° C. Fixing properties at low temperature may be improved by the binder resin A, and resistance to hot offset may be improved by the binder resin B. In this regard, the weight ratio of the binder resin A to the binder resin B may be in the range of 10:90 to 90:10. If the weight ratio of the binder resin A to the binder resin B is not within the range described above, fixing properties at low temperature or resistance to hot offset may be deteriorated.

The binder resin A and the binder resin B may be prepared by polymerizing one or more monomers.

The number average molecular weight and the Tg of each of the binder resin A and the binder resin B may be respectively controlled using at least one of the following methods (i) to (iii).

(i) controlling the composition of monomers;

(ii) adding a macromonomer;

(ii) adding a chain transfer agent;

Hereinafter, the binder resin will be described in more detail.

The binder resins A and B may include a styrene-acrylic resin. The styrene-acrylic resin may be prepared by copolymerizing a radical-polymerizable vinyl monomer including a styrene monomer and/or an acrylic monomer.

The styrene monomer may include styrene, o-methyl styrene, m-methyl styrene, p-methyl styrene, α-methyl styrene, p-ethyl styrene, 2,4-dimethyl styrene, p-n-butyl styrene, p-tert-butyl styrene, p-n-hexyl styrene, p-n-octyle styrene, p-n-nonyl styrene, p-n-decyl styrene, p-n-dodecyl styrene, p-methoxy styrene, p-phenyl styrene, 3,4-dichloro styrene, or the like. The styrene monomer may be used alone or in a combination.

In addition, the acrylic monomer may include acrylic acid, ethyl acrylate, methyl acrylate, n-butyl acrylate, t-butyl acrylate, 2-ethylhexyl acrylate, isobutyl acrylate, propyl acrylate, dodecyl acrylate, lauryl acrylate, stearyl acrylate, phenyl acrylate, glycidyl acrylate, 2-hydroxymethyl acrylate, 2-hydroxyethyl acrylate, benzyl acrylate, methacrylic acid, ethyl methacrylate, methyl methacrylate, n-butyl methacrylate, t-butyl methacrylate, 2-ethylhexyl methacrylate, isobutyl methacrylate, propyl methacrylate, dodecyl methacrylate, lauryl methacrylate, stearyl methacrylate, phenyl methacrylate, glycidyl methacrylate, 2-hydroxymethyl methacrylate, 2-hydroxyethyl methacrylate, benzyl methacrylate, dimethylaminoethyl methacrylate, diethylaminoethyl methacrylate, or the like.

In addition, the polymerizable vinyl monomer may be an unsaturated dibasic acid such as maleic acid, butyl maleate, methyl maleate, dimethyl maleate, fumaric acid, butyl fumarate, dibutyl fumarate, diisobutyl fumarate, dimethyl fumarate, or diethyl fumarate; a monomer to which ε-caprolactone and an acrylic monomer are added; or a bisphenol A derivative-based acrylic monomer, or combinations thereof.

Generally, a polymerization initiator may be used in order to initiate the polymerization. Examples of the polymerization initiator are a benzoyl peroxide-based polymerization initiator and an azo-based polymerization initiator.

More particularly, the polymerization initiator may be selected from the group consisting of: an azo-based polymerization initiator such as 2-2'-azobisisobutyronitrile; ketone peroxide such as methylethylketoneperoxide; peroxyketal such as 1,1-bis(t-butylperoxy)-3,3,5-trimethylcyclohexane; hydroperoxide such as t-butylhydroperoxide; dialkylperoxide such as di-t-butylperoxide; diacylperoxide such as isobutylperoxide; peroxydicarbonate such as di-isopropylperoxy dicarbonate; sulfonyl peroxide such as acetylcyclohexylsulfonyl peroxide; and peroxyester such as t-butylperoxy acetate.

In this regard, the acid value of each of the binder resin A and the binder resin B may be in the range of 0.5 to 30 mgKOH/g, for example 1 to 25 mgKOH/g, but is not limited thereto.

In this regard, the total amount of the binder resins A and B may be in the range of 50 to 98 parts by weight based on 100 parts by weight of the toner composition. If the total amount of the binder resins A and B is less than 50 parts by weight based on 100 parts by weight of the toner composition, the binder resins A and B are insufficient for binding the toner composition. On the other hand, if the total amount of the binder resins A and B is greater than 98 parts by weight based on 100 parts by weight of the toner composition, the amount of the toner composition except for the binder resins A and B is too small to preserve the function of the toner. In this regard, the toner composition may further include a cross-linked resin, a coloring agent, an additive, and an external additive, which will be described later, in addition to the binder resins A and B.

The macromonomer used to control the number average molecular weight and the Tg of the binder resins A and B may be poly(ethylene glycol) ethyl ether methacrylate, poly(ethylene glycol) methyl methacrylate, poly(ethylene glycol) methyl acrylate, or the like, and the chain transfer agent may be divinylbenzene, 1-dodecanethiol, or the like.

The chain transfer agent used to control the molecular weight of the binder resins A and B during the preparation of the binder resins A and B may be α-methylstyrene dimer, n-dodecyl mercaptan, thioglycolic acid 2-ethylhexyl ester, n-octyl mercaptan, or the like.

In addition, the amounts of the macromonomer and the chain transfer agent may respectively be in the range of 0.3 to 30 parts by weight and in the range of 0.1 to 10 parts by weight based on 100 parts by weight of the binder resins A and B.

A portion of the binder resins A and/or B may be subjected to a reaction with the cross-linking agent which may be an isocyanate compound or an epoxy compound.

A cross-linked resin is formed by the cross-linking of the binder resins A and B using the cross-linking agent, and the amount of the cross-linked resin contained in the toner may be in the rage of 5 to 30 parts by weight based on 100 parts by weight of the uncross-linked binder resins A and B. If the amount of the cross-linked resin is less than 5 parts by weight based on 100 parts by weight of the uncross-linked binder resins A and B, fixing temperature range decreases due to too small molecular weight. If the amount of the cross-linked resin is greater than 30 parts by weight based on 100 parts by weight of the uncross-linked binder resins A and B, the binder resins A and B are too rigid to be fixed at low temperature.

Hereinafter, the coloring agent will be described in more detail.

The coloring agent may be used in the form of a pigment itself, or alternatively, in the form of a pigment master batch in which the pigment is dispersed in a resin.

The pigment may be selected from pigments commonly and commercially used, such as a black pigment, a cyan pigment, a magenta pigment, a yellow pigment, and mixtures thereof.

Examples of the pigments are described below. The black pigment may be a titanium oxide or carbon black. The cyan pigment may be a copper phthalocyanine compound or derivatives thereof, an anthraquine compound, or a base dye lake compound. The magenta pigment may be a condensed nitrogen compound, an anthraquine compound, a quinacridone compound, a base dye lake compound, a naphthol compound, a benzo imidazole compound, a thioindigo compound, or a perylene compound. The yellow pigment may be a condensed nitrogen compound, an isoindolinone compound, an anthraquine compound, an azo metal complex, or an allyl imide compound.

The amount of the coloring agent may be sufficient to color the toner and form a visible image by development, for example, in the range of 1 to 20 parts by weight based on 100 parts by weight of the binder resins A and B.

The additive may include a charge control agent, a releasing agent, or mixtures thereof.

The charge control agent may be a negative charge control agent or a positive charge control agent. Examples of the negative charge control agent include an organic metal complex or a chelate compound; a salicylic acid compound containing metal; and an organic metal complex of an aromatic hydroxycarboxylic acid and an aromatic dicarboxylic acid, and any known negative charge control agent may be used without limitation. Examples of the positive charge control agent include nigrosine and products of nigrosine modified with a fatty acid metal salt, and an onium salt including a quaternary ammonium salt. These charge control agents may be used alone or in combinations thereof. Since the charge control agent stably and quickly charges a toner by its electrostatic force, the toner may be stably supported on a developing roller.

The amount of the charge control agent may be in the range of 0.1 to 10 parts by weight based on 100 parts by weight of the toner composition.

The releasing agent may enhance the fixing properties of a toner image, and examples of the releasing agent include polyalkylene wax such as low molecular weight polypropylene or low molecular weight polyethylene, ester wax, carnauba wax, and paraffin wax. The amount of the releasing agent contained in the toner may be in the range of 0.1 to 30 parts by weight based on 100 parts by weight of the toner composition. If the amount of the releasing agent is less than 0.1 parts by weight based on 100 parts by weight of the toner composition, oilless fixing of toner particles in which toner particles are fixed without using oil may not be performed. On the other hand, if the amount of the releasing agent is greater than 30 parts by weight based on 100 parts by weight of the toner composition, toner may be flocculated while it is stored.

The additive may further include an external additive. The external additive may be used to improve fluidity of toner or control charge properties, and examples of the external additive are large particulate silica, small particulate silica, and polymer beads.

The toner having multiple inflection points according to the present embodiment may be prepared by melt-mixing at least two types of heterogeneous binder resins and pulverizing the resultant; by aggregating heterogeneous binder resin latexes; or dissolving heterogeneous binder resins in a solvent, dispersing the resultant in a dispersing medium such as water, and removing the solvent and the dispersing medium.

The toner according to the present embodiment and prepared as described above may be used in an electrophotographic image forming apparatus. In this regard, the electrophotographic image forming apparatus may be a laser printer, a photocopier, a facsimile, or the like.

Hereinafter, the present invention will be described in more detail with reference to the following examples. These examples are for illustrative purposes only and are not intended to limit the scope of the invention.

EXAMPLES

Synthesis of Binder Resin

Preparation Example 1

Preparation of a Particulate Suspension of a Binder Resin A

A 3 L reactor equipped with a stirrer, a thermometer, and a condenser was installed in an oil bath containing a heat transfer medium. 660 g of distilled water and 3.2 g of a surfactant (Dowfax 2A1) were added to the reactor, and the reactor was heated to 70° C. and stirred at 100 rpm. Then, monomers, i.e., 838 g of styrene, 322 g of butyl acrylate, 37 g of 2-carboxyethyl acrylate, and 22.6 g of 1,10-decanediol diacrylate, 507.5 g of distilled water, 22.6 g of the surfactant (Dowfax 2A1), 53 g of poly(ethylene glycol) ethyl ether mathacrylate, as a macromonomer, and 18.8 g of 1-dodecanethiol, as a chain transfer agent, were slowly added thereto for 1 hour. Then, the reaction was performed for about 8 hours, and then the reactor was slowly cooled to room temperature to complete the reaction. As a result, a particulate suspension of a binder resin A was obtained.

The glass transition temperature (Tg) of the binder resin A measured using a differential scanning calorimeter (DSC) was 57° C. The number average molecular weight of the binder resin A measured using a gel permeation chromatography (GPC) using polystyrene as a standard sample was 15,000.

Preparation Example 2

Preparation of a Particulate Suspension of a Binder Resin B

A particulate suspension of a binder resin B was prepared in the same manner as in Example 1, except that 970 g of styrene, 191.6 g of butyl acrylate, 37 g of 2-carboxyethyl acrylate, and 22.6 g of 1,10-decanediol diacrylate as monomers were used. The glass transition temperature (Tg) of the binder resin B measured using a DSC was 65° C. The number average molecular weight of the binder resin B measured using a GPC using polystyrene as a standard sample was 18,000.

Synthesis of Cross-Linked Resin

Preparation Example 3

Preparation of a Particulate Suspension of a Cross-linked Resin C

A 3 L reactor equipped with a stirrer, a thermometer, and a condenser was installed in an oil bath containing a heat transfer medium. 2000 g of the particulate suspension of the binder resin A prepared according to Preparation Example 1, 200 g of distilled water, 0.5 g of a surfactant (Dowfax 2A1), and 1.03 g of a cross-linking agent (n-dodecyl mercaptan) were added to the reactor, and the reactor was heated to 70° C. and stirred at 100 rpm. Then, the reaction was performed for about 4 hours, and then the reactor was slowly cooled to room temperature to complete the reaction. As a result, a particulate suspension of a cross-linked resin C was obtained.

Preparation of Coloring Pigment

Preparation Example 4

Preparation of Cyan Pigment Dispersion 540 g of a cyan pigment (Daicolor Pigment MFG. Co. Ltd., Japan, ECB303), 27 g of a surfactant (Dowfax 2A1), and 2,450 g of distilled water were added to a 3 L reactor equipped with a stirrer, a thermometer, and a condenser, and the reactor content was slowly stirred for about 10 hours to obtain a pre-dispersion. The pre-dispersion was further dispersed using a beads mill (Netzsch, Germany, Zeta RS) for 4 hours. As a result, a cyan pigment dispersion was obtained.

Then, the particle size of the cyan pigment was measured using a Multisizer 2000 (Malvern Instruments, Ltd.), and D50(v) was 170 nm. In this regard, when the volume of toner particles is accumulated from particles of the smallest size in ascending order until the accumulated volume reaches 50% of the total volume of the toner, an average particle size of the accumulated particles corresponding to 50% of the total volume of the toner is defined as D50(v).

Preparation Example 5

Preparation of Wax Dispersion 65 g of a surfactant (Dowfax 2A1), and 1,935 g of distilled water were added to a 5 L reactor equipped with a stirrer, a thermometer, and a condenser, and 1,000 g of wax (NOF Corporation, Japan, WE-5) was added to the reactor while slowly stirring the reactor content at a high temperature (100° C.) for about 2 hours. The reactor content was dispersed for 30 minutes using a homogenizer (IKA, T-45). As a result, a wax pigment dispersion was obtained.

Then, the particle size of the wax was measured using a Multisizer 2000 (Malvern Instruments, Ltd.), and D50(v) was 320 nm.

Preparation of Toner Particles

Example 1

Preparation of Toner Particles (A+B)

1527 g of distilled water, 335 g of the particulate suspension of the binder resin A prepared according to Preparation Example 1, 335 g of the particulate suspension of the binder resin B prepared according to Preparation Example 2, 84 g of the cyan pigment dispersion prepared according to Preparation Example 4, and 88.3 g of the wax dispersion prepared according to Preparation Example 5 were sequentially added to a 3 L reactor equipped with a stirrer, a thermometer, and a condenser, and the reactor was stirred for about 10 minutes. Then, the mixture was dispersed for about 30 minutes using a homogenizer (IKA, T-45) while slowly adding 49.2 g of an aggregating agent (PSI:HCl=1:1) for about 10 minutes. The dispersed slurry was heated to 50° C. When, the D50(v) reached 6.6 μm, 2N NaOH was added thereto until the pH reached 7. When the growth of the D50(v) stopped, the dispersed slurry was heated to 98° C., and the temperature was maintained until the sphericity of the toner particles reached 0.990, and then the resultant was cooled to room temperature.

As a result of analyzing the toner particles, the obtained toner particles had a volume average particle size of 6.8 μm.

Example 2

Preparation of Toner Particles (A+B+C)

Toner particles were prepared in the same manner as in Example 1, except that 268 g of the particulate suspension of the binder resin A, 268 g of the particulate suspension of the binder resin B, and 134 g of the particulate suspension of the cross-linked resin C prepared according to Preparation Example 3 were used.

As a result of analyzing the toner particles, the obtained toner particles had a volume average particle size of 6.8 μm.

Comparative Example 1

Preparation of Toner Particles (A)

Toner particles were prepared in the same manner as in Example 1, except that 670 g of the particulate suspension of the binder resin A was used without using the particulate suspension of the binder resin B.

As a result of analyzing the toner particles, the obtained toner particles had a volume average particle size of 6.8 μm.

Comparative Example 2

Preparation of Toner Particles (B)

Toner particles were prepared in the same manner as in Example 1, except that 670 g of the particulate suspension of the binder resin B was used without using the particulate suspension of the binder resin A.

As a result of analyzing the toner particles, the obtained toner particles had a volume average particle size of 6.8 μm.

The volume average particle sizes of the toner particles prepared according to Examples 1 and 2 and Comparative Examples 1 and 2 were measured using a Coulter Multisizer 3. Apertures of 100 μm were used in the Coulter Multisizer 3, an appropriate amount of a surfactant (Dowfax 2A1) was added to 50 to 100 ml of ISOTON-II (Beckman Coulter Co.), as an electrolyte, and 10 to 15 mg of a sample to be measured was added thereto, and the resultant was dispersed in an ultrasonic dispersing apparatus for 5 minutes to prepare a sample for the Coulter Multisizer 3.

Evaluation Example

Physical properties of the toner particles prepared according to Examples 1 and 2 and Comparative Examples 1 and 2 were evaluated using the following methods.

Storage Modulus

Figure 2:
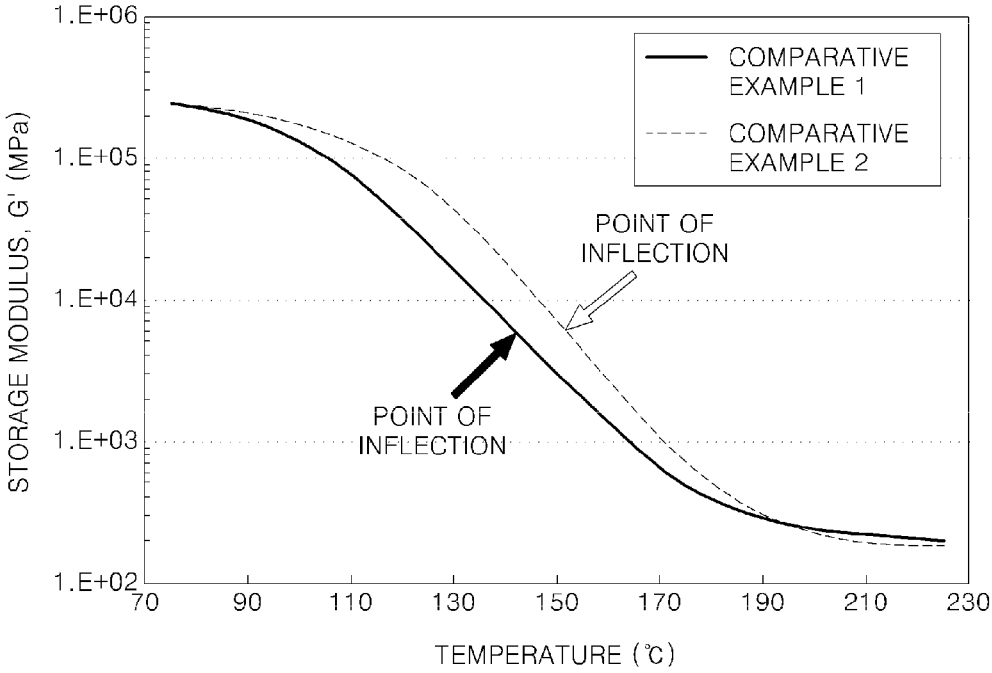
FIG. 2 is a graph illustrating storage moduli, with respect to temperature, of conventional toners prepared according to Comparative Examples 1 and 2.

Storage moduli of toners prepared according to Examples 1 and 2 and Comparative Examples 1 and 2 were measured using an ARES Rheometer (TI Instrument, ARES-LS2), and the results are shown in Table 2 and FIGS. 1 and 2.

TABLE 1

| Toner | Weight ratio of each resin to the total resin contained in toner particle | | |
|---|---|---|---|
| | Binder resin A | Binder resin B | Cross-linked resin C |
| Example 1 | 1/2 | 1/2 | — |
| Example 2 | 2/5 | 2/5 | 1/5 |
| Comparative Example 1 | 1 | — | — |
| Comparative Example 2 | — | 1 | — |

TABLE 2

| Temperature (T), ° C. | Storage modulus (G'), MPa | | | |
|---|---|---|---|---|
| | Example 1 | Example 2 | Comparative Example 1 | Comparative Example 2 |
| 80 | $2.0 \times 10^5$ | $1.4 \times 10^5$ | $2.4 \times 10^5$ | $2.4 \times 10^5$ |
| 100 | $1.0 \times 10^5$ | $7.0 \times 10^4$ | $1.2 \times 10^5$ | $1.8 \times 10^5$ |
| 120 | $1.3 \times 10^4$ | $1.3 \times 10^4$ | $3.8 \times 10^4$ | $7.9 \times 10^4$ |
| 140 | $3.8 \times 10^3$ | $5.3 \times 10^3$ | $7.2 \times 10^3$ | $2.1 \times 10^4$ |
| 160 | $3.4 \times 10^3$ | $3.0 \times 10^3$ | $1.8 \times 10^3$ | $3.0 \times 10^3$ |
| 180 | $1.7 \times 10^3$ | $1.3 \times 10^3$ | $3.7 \times 10^2$ | $4.9 \times 10^2$ |
| 200 | $2.8 \times 10^2$ | $2.3 \times 10^2$ | $1.6 \times 10^2$ | $1.3 \times 10^2$ |
| 220 | $1.8 \times 10^2$ | $1.9 \times 10^2$ | $1.2 \times 10^2$ | $0.9 \times 10^2$ |

Referring to FIGS. 1 and 2, three inflection points of the storage modulus (G') curve were observed at 114° C., 152° C., and 189° C. when two types of binder resins were used as in Example 1, and three inflection points of the storage modulus (G') were observed at 110° C., 152° C., and 187° C. when two types of binder resins and a single cross-linked resin were used as in Example 2. On the other hand, only one inflection point of the storage modulus (G') curve was observed respectively at 141° C. and 152° C. when a single binder resin is used as in Comparative Examples 1 and 2. According to the number of inflection points of the storage modulus (G') curve, physical properties of toner vary.

Fixing Temperature Range: Fixing Properties at Low Temperature and Resistance to Hot Offset 100 g of toner particles, 2 g of silica (TG 810G, Cabot Co.), and 0.5 g of silica (RX50, Degussa GmbH) were mixed to prepare a toner. Using the toner, unfixed solid images of 30 mm×40 mm were formed using a Samsung CLP-510 printer. Then, fixing properties of the unfixed images were evaluated while varying the temperature of a fixing roller of a fixing tester in which the fixing temperature could be controlled. The fixing temperature range of the toner was measured, and the results are shown in Table 3 below.

TABLE 3

| Examples | Fixing temperature range (° C.) |
|---|---|
| Example 1 | 130 to 200 |
| Example 2 | 130 to 210 |
| Comparative Example 1 | 130 to 180 |
| Comparative Example 2 | 160 to 200 |

Referring to Table 3, the fixing temperature range of the toner prepared using the two types of binder resins according to Example 1 was 130 to 200° C., indicating the increase of the fixing temperature range. The fixing temperature range of the toner prepared using the two types of binder resins and a single type cross-linked resin according to Example 2 was 130 to 210° C. According to the result, even though toner cannot be prepared only using the cross-linked resin due to excessive hardness of the toner particle, fixing properties of the toner at high temperature may be improved when the cross-linked resin is used with other binder resins. In this regard, the fixing properties at high temperature indicate resistance to hot offset. On the other hand, the fixing temperature ranges of the toner prepared using a single binder resin according to Comparative Examples 1 and 2 were respectively 130 to 180° C. and 160 to 200° C. Thus, the toner prepared according to Comparative Example 1 has poor resistance to hot offset, and the toner prepared according to Comparative Example 2 has poor fixing properties at low temperature.

Heat-Resistant Storage Properties 0.2 g of silica (TG 810G, Cabot Co.) and 0.05 of silica (RX50, Degussa GmbH) were mixed with 10 g of each of the toner particles prepared according to Examples 1 and 2 and Comparative Examples 1 and 2 to prepare 10.25 g of toner. Then, the toner was placed in a 25 ml glass bottle for 72 hours at 50° C. and a humidity of 80%, and then heat-resistant storage properties of the toner were evaluated with the naked eye. The evaluation results are shown in Table 4, using ○, Δ, and x as defined as follows.

○: No flocculation, thus no problem.

Δ: Weak flocculation but flocculated particles are scattered when shaking, no substantial problem.

x: Strong flocculation and not scattered, substantial problem.

TABLE 4

| Examples | Heat-resistant storage properties |
|---|---|
| Example 1 | ○ |
| Example 2 | ○ |
| Comparative Example 1 | x |
| Comparative Example 2 | ○ |

Referring to Table 4, while the toners prepared according to Examples 1 and 2 and Comparative Example 2 have excellent heat-resistant storage properties, the toner prepared according to Comparative Example 1 has poor heat-resistant storage properties.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A toner comprising a binder resin, a coloring agent, and at least one additive, wherein a storage modulus (G') curve of the toner with respect to temperature (T) has multiple inflection points, wherein all the multiple inflection points exist at a temperature ranging from 100 to 200° C., and wherein a width of a fixing temperature range is 70° C. or more.

2. The toner of claim 1, wherein the binder resin comprises multiple types of binder resins having different number average molecular weights and glass transition temperatures (Tg).

3. The toner of claim 2, wherein the binder resin comprises a binder resin A having a number average molecular weight ranging from 5,000 to 30,000 and a glass transition temperature (Tg) ranging from 55 to 60° C. and a binder resin B having a number average molecular weight ranging from 5,000 to 30,000 and a glass transition temperature (Tg) ranging from 62 to 67° C.

4. The toner of claim 3, wherein the weight ratio of the binder resin A to the binder resin B is in the range of 10:90 to 90:10.

5. The toner of claim 1, further comprising a cross-linked resin.

6. An electrophotographic image forming apparatus employing a toner according to claim 1.

* * * * *